US012760888B2

(12) United States Patent
Shah et al.

(10) Patent No.: US 12,760,888 B2
(45) Date of Patent: Oct. 13, 2026

(54) WATER HEATER AND BOILER PROCESSES

(71) Applicant: Aerco International, Inc., Blauvelt, NY (US)

(72) Inventors: Kunal Shah, Airmont, NY (US); Nery Hernandez, Denver, CO (US); Scott McGrath, Newton, NJ (US); Joseph Bentitou, New City, NY (US)

(73) Assignee: Aerco International, Inc., Blauvelt, NY (US)

( * ) Notice: Subject to any disclaimer, the term of this patent is extended or adjusted under 35 U.S.C. 154(b) by 527 days.

(21) Appl. No.: 17/989,286

(22) Filed: Nov. 17, 2022

(65) Prior Publication Data

US 2023/0077846 A1 Mar. 16, 2023

Related U.S. Application Data

(63) Continuation of application No. 16/861,690, filed on Apr. 29, 2020.

(60) Provisional application No. 62/842,013, filed on May 2, 2019.

(51) Int. Cl.

| | |
|---|---|
| ***F22B 35/18*** | (2006.01) |
| ***F22B 37/42*** | (2006.01) |
| ***F23N 1/08*** | (2006.01) |

(52) U.S. Cl.

CPC ..... *F22B 35/18* (2013.01); *F22B 37/42* (2013.01)

(58) Field of Classification Search

CPC ..... F22B 35/008; F22B 35/18; F22B 37/42; F24D 2200/043

See application file for complete search history.

(56) References Cited

U.S. PATENT DOCUMENTS

| | | | | |
|---|---|---|---|---|
| 5,368,013 | A * | 11/1994 | Herweyer | F24D 12/02 122/14.31 |
| 6,059,195 | A | 5/2000 | Adams et al. | |
| 2012/0192813 | A1 | 8/2012 | Evans et al. | |
| 2018/0356125 | A1 | 12/2018 | Fioriti | |

FOREIGN PATENT DOCUMENTS

| | | | | |
|---|---|---|---|---|
| CN | 105422953 | A * | 3/2016 | F16K 17/36 |
| JP | 2012088004 | A * | 5/2012 | |

OTHER PUBLICATIONS

Kucera et al, CN105422953 and translation (Year: 2016).*
Yamamoto et al, JP2012088004 and translation (Year: 2012).*

(Continued)

*Primary Examiner* — Steven S Anderson, II
(74) *Attorney, Agent, or Firm* — Harris Beach Murtha Cullina PLLC

(57) ABSTRACT

A pre-startup control method for a boiler or water heater includes: providing a controller operatively coupled to a boiler or water heater unit; performing a unit shutdown operation; enabling a pre-start up mode; at about a same time or in any order, moving an air fuel valve by a controller to a non-off position with a gas supply to the water heater or boiler turned off, wherein the controller turns on a blower at an operational level, and causes an ignitor to spark; and displaying parameters which allow an affirmation of a safe and reliable ignition prior to a gas turn on of the boiler or water heater unit. A flow balancing method and a programmed auto run method are also described.

13 Claims, 12 Drawing Sheets

(56) References Cited

OTHER PUBLICATIONS

Tricity, "Why isn't my gas water heater getting hot?", Jan. 2017, https://www.tricityappliance.corn/blog/2017/january/> why-isnt-my-gas-water-heater-getting-hot-/ (Year: 2017).
Aerco, Natural Gas Modulating and Condensing Hot water Boiler Models, https://d3pcsg2wjg9izr.cloudfront.net/files/77912/> download/475366/2.pdf (Year: 2013).
Fixya, Fixya, <https://www.fixya.corn/support/t8447057-am> getting message (Year: 2011).
Armstrong, 7 reasons your water heater isn't working,<https://arrnstrongcornfort.corn/Blog/7-reasons-your-water-heater-isnt-working> Year: 2018).
Trinity, Tx-Series 1O Manual, <https://ntiboilers.corn/wp-content/uploads/2018/12/Tx-Series-1O-Manual-2018-07.pdf><https://ntiboilers.corn/wp-content/uploads/2018/12/Tx-Series-1O-Manual-2018-07.pdf>07.pdf <https://ntiboilers.corn/wp-content/uploads/2018/12/Tx-Series-1O-Manual-2018-07.pdf> (Year: 2018).

* cited by examiner

Pre-Start UP

Programmed Auto Run

WATER HEATER AND BOILER PROCESSES

CROSS-REFERENCE TO RELATED APPLICATIONS

This application claims priority to and the benefit of U.S. provisional patent application Ser. No. 62/842,013, WATER HEATER AND BOILER PROCESSES, filed May 2, 2019, and U.S. provisional patent application Ser. No. 16/861,690, WATER HEATER AND BOILER PROCESSES, filed Apr. 29, 2020, now allowed, which applications are incorporated herein by reference in their entirety.

FIELD OF THE APPLICATION

The application relates to processes for a water heater or boiler, particularly to operation and troubleshooting modes for a water heater or boiler.

BACKGROUND

Newly installed or new construction commercial gas fired water heaters or boilers often require a gas company representative be present when the water heater or boiler is first fired. Some commercial installations operate a series of water heaters or boilers at the same time for increased heating capacity. Once operational, there can be certain sequences or profiles of operation which repeat only occasionally or seemingly at random times.

SUMMARY

A pre-startup control method for a boiler or water heater includes: providing a controller operatively coupled to a boiler or water heater unit; performing a unit shutdown operation; enabling a pre-start up mode; at about a same time or in any order, moving an air fuel valve by a controller to a non-off position with a gas supply to the water heater or boiler turned off, wherein the controller turns on a blower at an operational level associated with a set air fuel position, and the controller causes an ignitor to spark; and displaying parameters which allow an affirmation of a safe and reliable ignition prior to a gas turn on of the boiler or water heater unit.

A flow balancing method for a plant having a plurality of boilers or water heaters includes: providing a controller operatively coupled to a plurality of boiler or water heater units of a plant, each unit of the plant including an isolation valve; initiating by use of the controller a manual or automatic flow balancing process; shutting down the plant and setting each unit to a certain fire rate; and automatically setting valve position of each unit by the controller to achieve a common desired temperature rise across each water heater or boiler unit or adjusting a valve position of each unit manually by use of the controller to achieve a common desired temperature rise across each water heater or boiler unit.

A programmed auto run method for a boiler or water heater includes: providing a controller operatively coupled to a boiler or water heater unit; shutting down the boiler or water heater unit by the controller; setting at least one profile with a plurality of points, each point including a hold duration and a setpoint as a configured profile; running the boiler or water heater unit to recreate the configured profile by an on demand run of the configured profile; and on completion of run of the configured profile returning by the controller, the boiler or water heater unit to a normal mode of operation.

The foregoing and other aspects, features, and advantages of the application will become more apparent from the following description and from the claims.

BRIEF DESCRIPTION OF THE DRAWINGS

The features of the application can be better understood with reference to the drawings described below, and the claims. The drawings are not necessarily to scale, emphasis instead generally being placed upon illustrating the principles described herein. In the drawings, like numerals are used to indicate like parts throughout the various views.

DETAILED DESCRIPTION

The description is divided into three parts describing three new processes for water heaters or boilers: a control method—pre-start up, a flow balancing method, and a programmed auto run process.

Control Method-Pre-Start Up

One of the problems with commissioning a new water heater or boiler installation is to be able to know if the new water heater or boiler is functional and operational before the gas supply is turned on. A related problem is that utility company personnel called to inspect an installation and/or turn on the gas supply to a new water heater or boiler may be delayed or forced to make a second trip to the site, if when powered, the new water heater or boiler exhibits some fault which delays the inspection and gas turn on process.

A solution to the problem of commissioning a new water heater or boiler is a new procedure which allows a water heater or boiler technician to check the water heater or boiler unit before the gas is turned ON to the building. This new pre-start up procedure ensures that an installer or owner/operator can verify correct operation of the key gas and electric related components before calling for utility company personnel to inspect an installation. When the utility company person arrives on site, he or she does not have to come back after waiting for some time while an otherwise unexpected or unanticipated problem is fixed.

Figure 1:
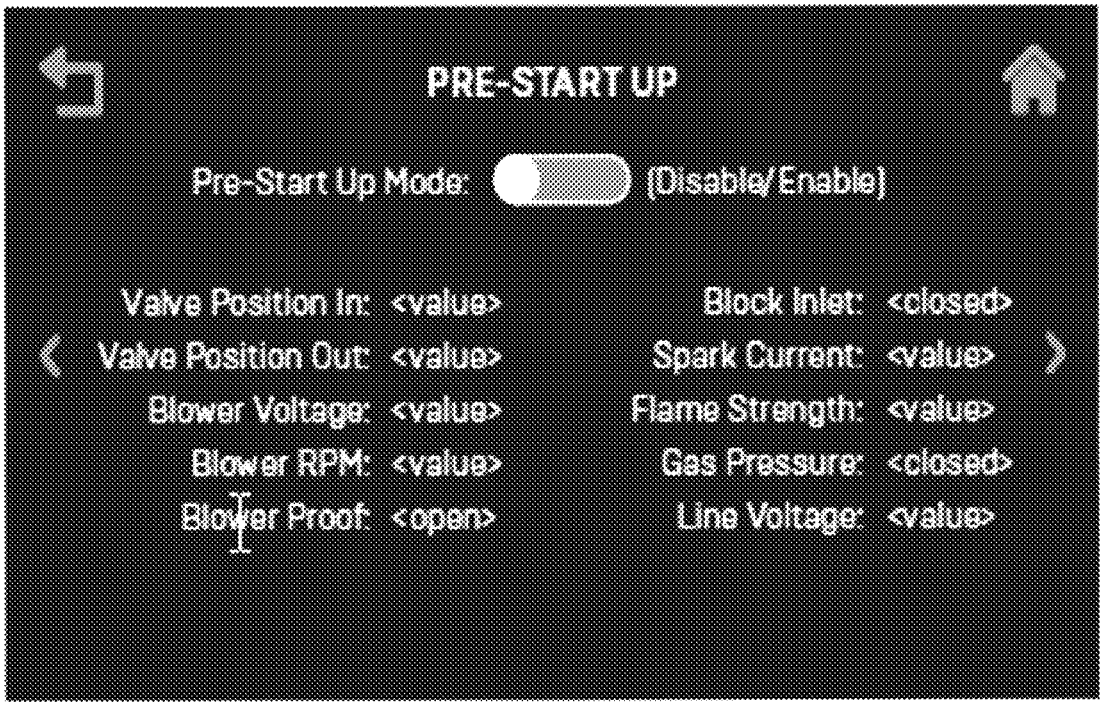
FIG. 1 is an exemplary graphical user interface (GUI) of a water heater or boiler controller display screen illustrating a new pre-start up procedure.

FIG. 1 is an exemplary graphical user interface (GUI) of a water heater or boiler controller display screen illustrating a new pre-start up procedure.

Figure 2:
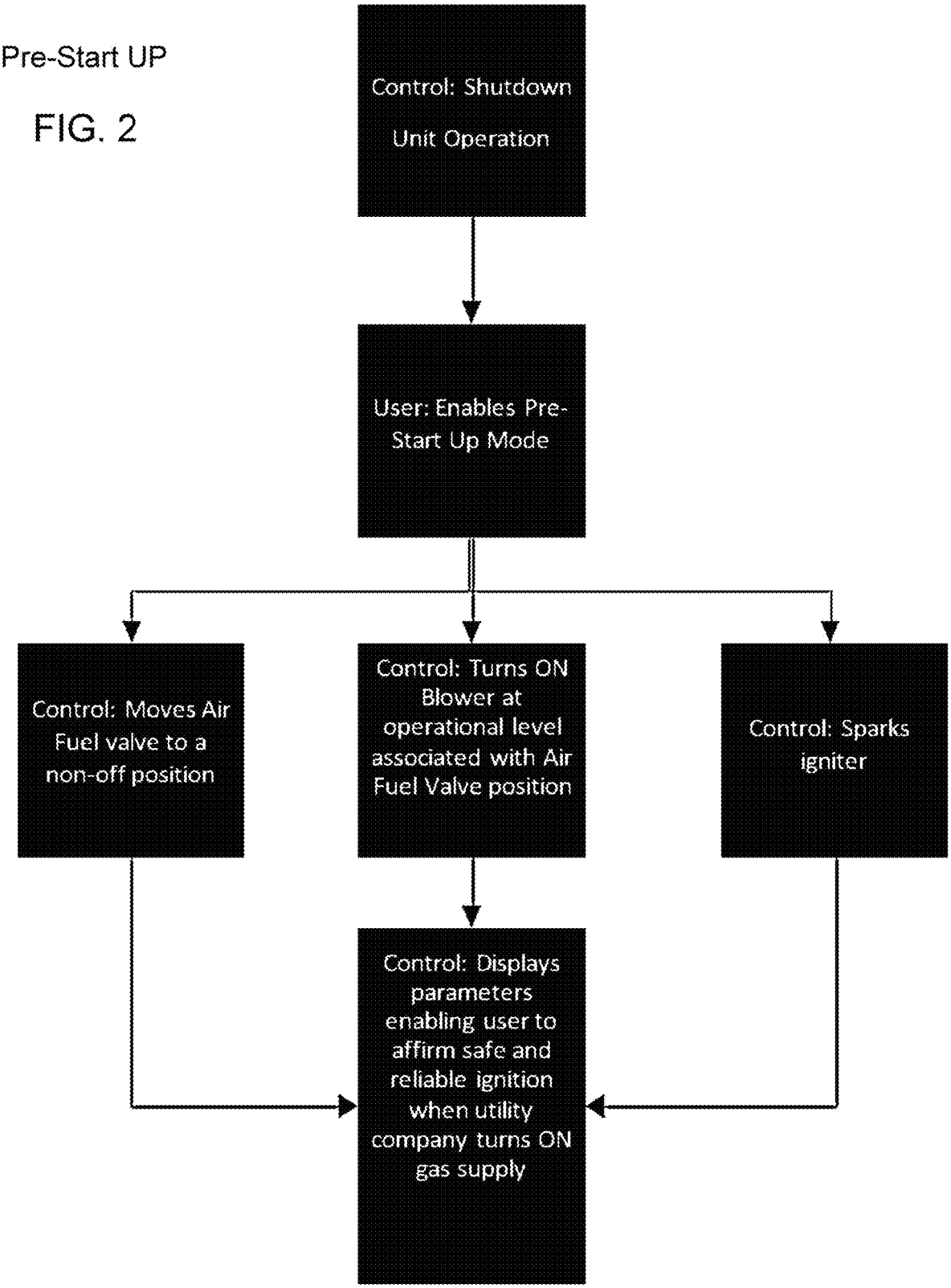
FIG. 2 is a flowchart showing an exemplary pre-start up procedure according to the Application.

FIG. 2 is a flowchart showing an exemplary pre-start up procedure according to the Application. The controller A) performs a unit shutdown operation; B) a user can enable the pre-start up mode, such as by making a selection on the pre-start up GUI of FIG. 1; C) about at the same time, or in any order, the controller moves an air fuel vale to a non-off position (with the gas supply to the water heater or boiler turned off), the controller turns on a blower at an operational level associated with the set air fuel position, and the controller causes an ignitor to spark. The steps of C can be performed in any suitable order; D) the water heater or boiler controller displays parameters allowing a user to affirm a safe and reliable ignition before the utility company representative arrives to turn ON the gas supply to the water heater or boiler. Step D can occur after each individual operation/test of step C, or at the conclusion of several or all of the steps of step C.

Flow Balancing Method

A plant can include two or more water heaters or boilers which can operate in concert as a "cascade". For example, a boiler sequencing technology as an exemplary Boiler Sequencing Technology system (BST) can operate up to 16 boilers as part of an integrated boiler control system. When there is a demand, the Manager will light off one of the boilers based on the BST Sequencing selection in the BST Cascade Status screen. When there is a demand, the Manager will light off one of the boilers based on the BST Sequencing selection in the BST Cascade Status screen. As the systems load, the Manager will light off the next available unit.

In any multiunit system, such as the exemplary BST Cascade described hereinabove, it is desirable to balance units operating at the same time. A Valve Balancing screen GUI can be used to setup and configure a Balanced Flow Isolation Valve feature. The goal of this Valve Balancing feature is to raise or lower all unit's current AT (water outlet temp minus water inlet temp) to match the plant's target AT, thereby balancing the load across multiple boilers (e.g. multiple boilers in a BST cascade). Prior to balancing, in normal operation all isolation valves (each unit is connected to the cascade by an isolation valve) are either fully closed or fully open (0% or 100% open). Valve balancing is accomplished by reducing the isolation valve's "fully open" position, thereby restricting the flow from the unit's hot water outlet, as needed, until the unit's AT matches the plant's target AT. This can be repeated on the other units in the BST cascade until each unit's AT is approximately the same.

Figure 3:
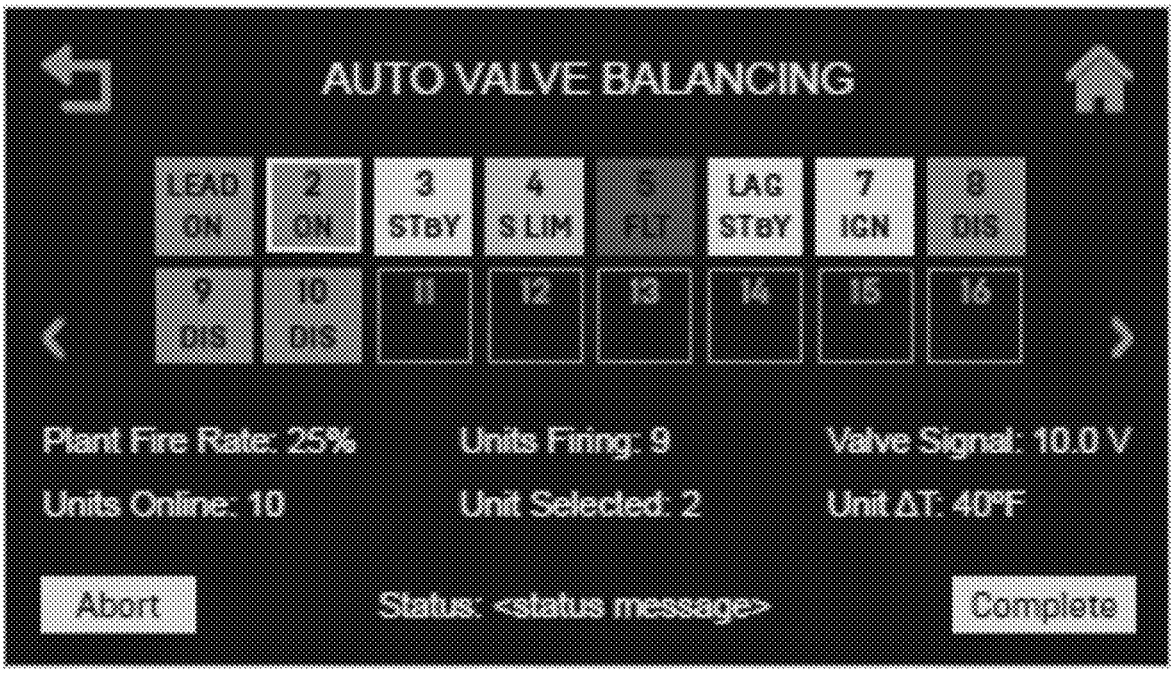
FIG. 3 is a drawing showing an exemplary GUI screen for an auto valve balancing.
Figure 4:
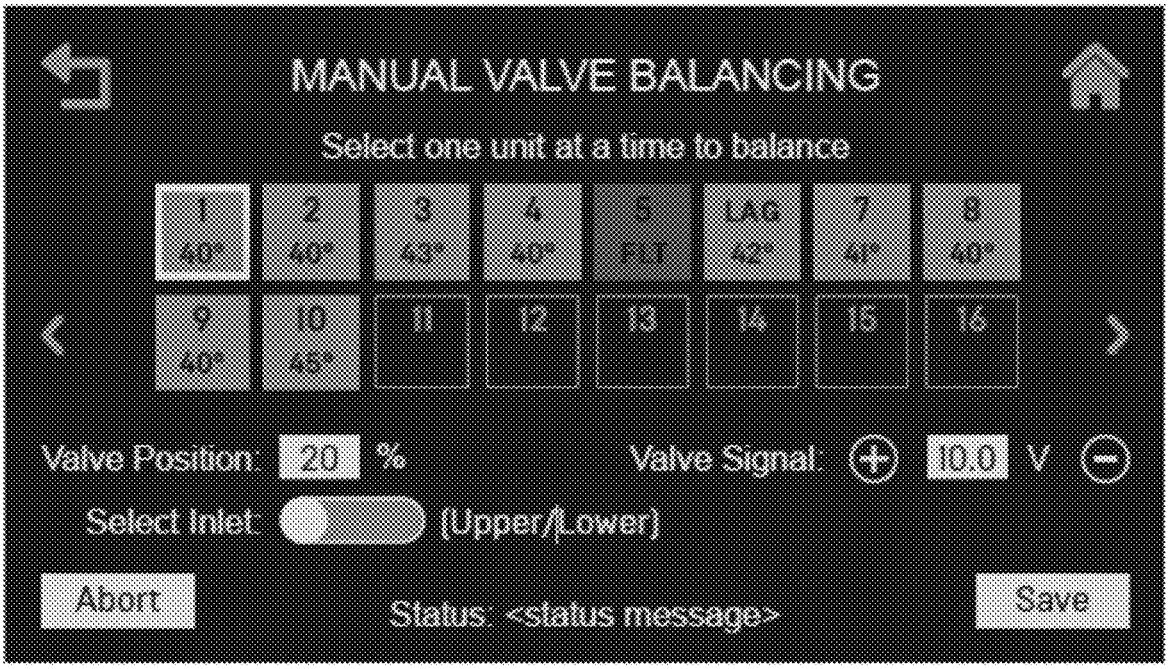
FIG. 4 is a drawing showing an exemplary GUI screen for a manual valve balancing.

FIG. 3 is a drawing showing an exemplary GUI screen for an auto valve balancing. FIG. 4 is a drawing showing an exemplary GUI screen for a manual valve balancing.

Figure 5:
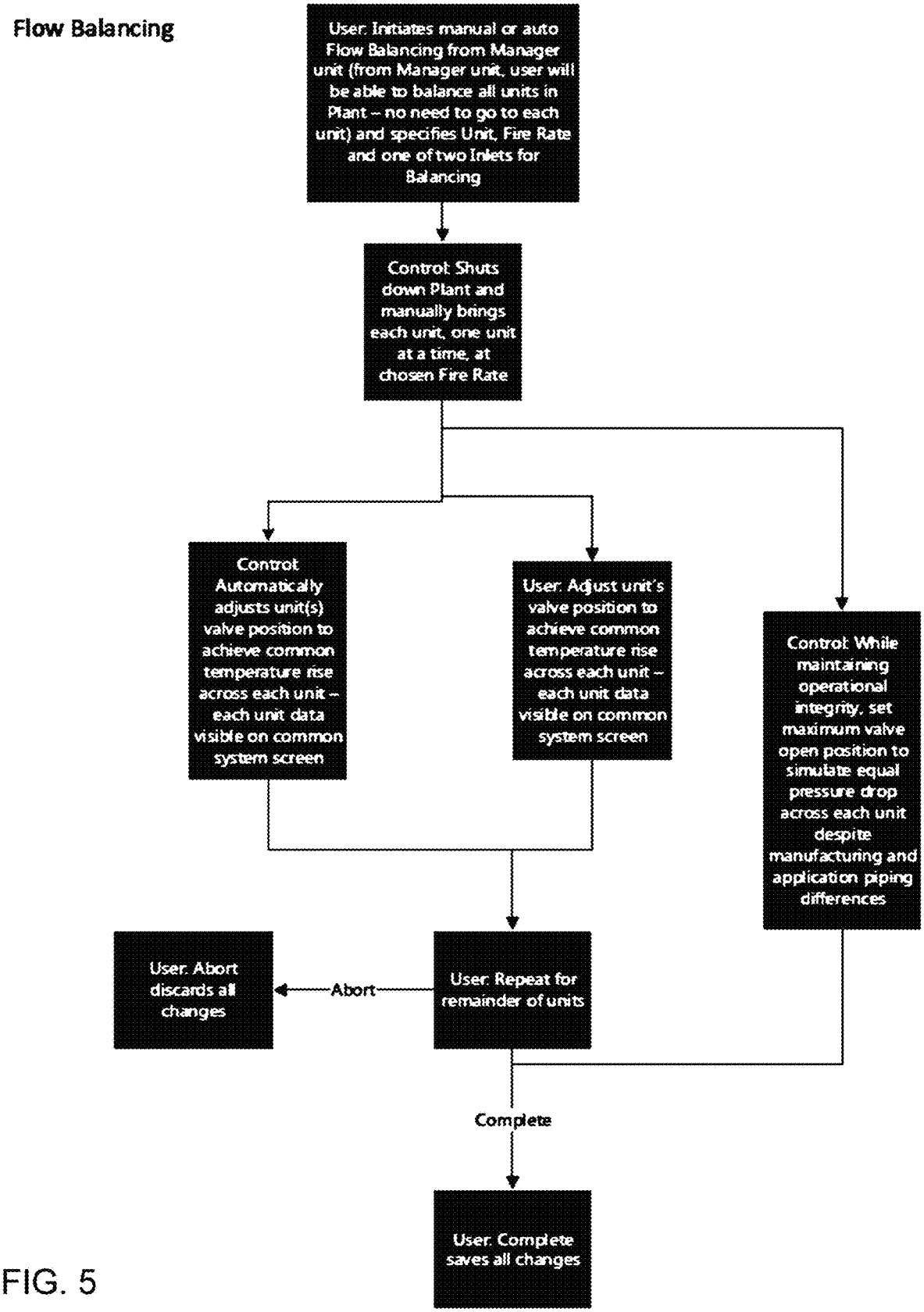
FIG. 5 shows an exemplary flow chart to perform the new flow balancing method.

FIG. 5 shows an exemplary flow chart to perform the new flow balancing method. The exemplary method steps include: A) A user (typically and owner or operator), initiates a manual or automatic flow balancing process at a touch screen of one of the units at a plant having two or more hot water heaters or boilers, each with a controller configured for the new method. B) The controller shuts down the plant and sets each unit to a certain fire rate (pre-set, or settable). C) In the automatic mode, the controller automatically each valve position of each unit to achieve a common desired temperature rise (pre-set or settable) across each water heater or boiler unit. Alternatively, in a manual mode, the user adjusts a valve position of each unit manually (from the single controller GUI being used on one controller of one unit) to achieve a common temperature rise across each unit.

In manual mode, a user can select one unit at a time to balance. However, in automatic mode, the system controller goes through each unit automatically.

FIG. 8 to FIG. 12 illustrate an exemplary Boiler for performing the new methods, such as, for example, including the new pre-startup control method for a boiler or water heater. Line voltage (for example, as displayed in FIG. 1) is the voltage of the AC building electrical power provided to the boiler system.

Figure 8:
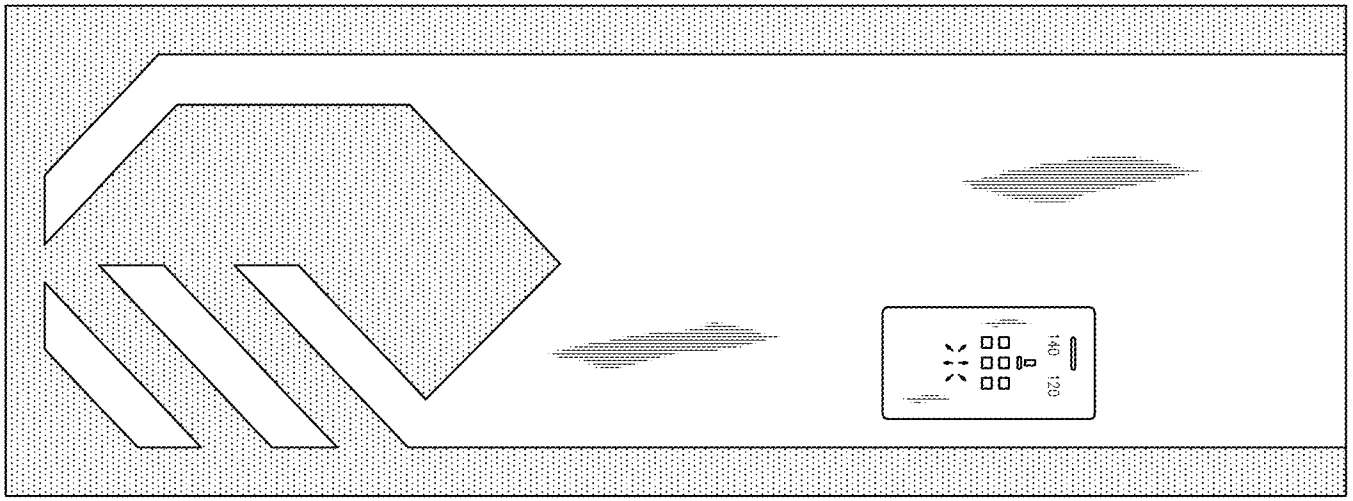
FIG. 8 is a drawing which shows an exemplary boiler, an AERCO Benchmark boiler having a controller in the front panel.

FIG. 8 is a drawing which shows an exemplary boiler, an AERCO Benchmark boiler having a controller in the front panel.

Figure 9:
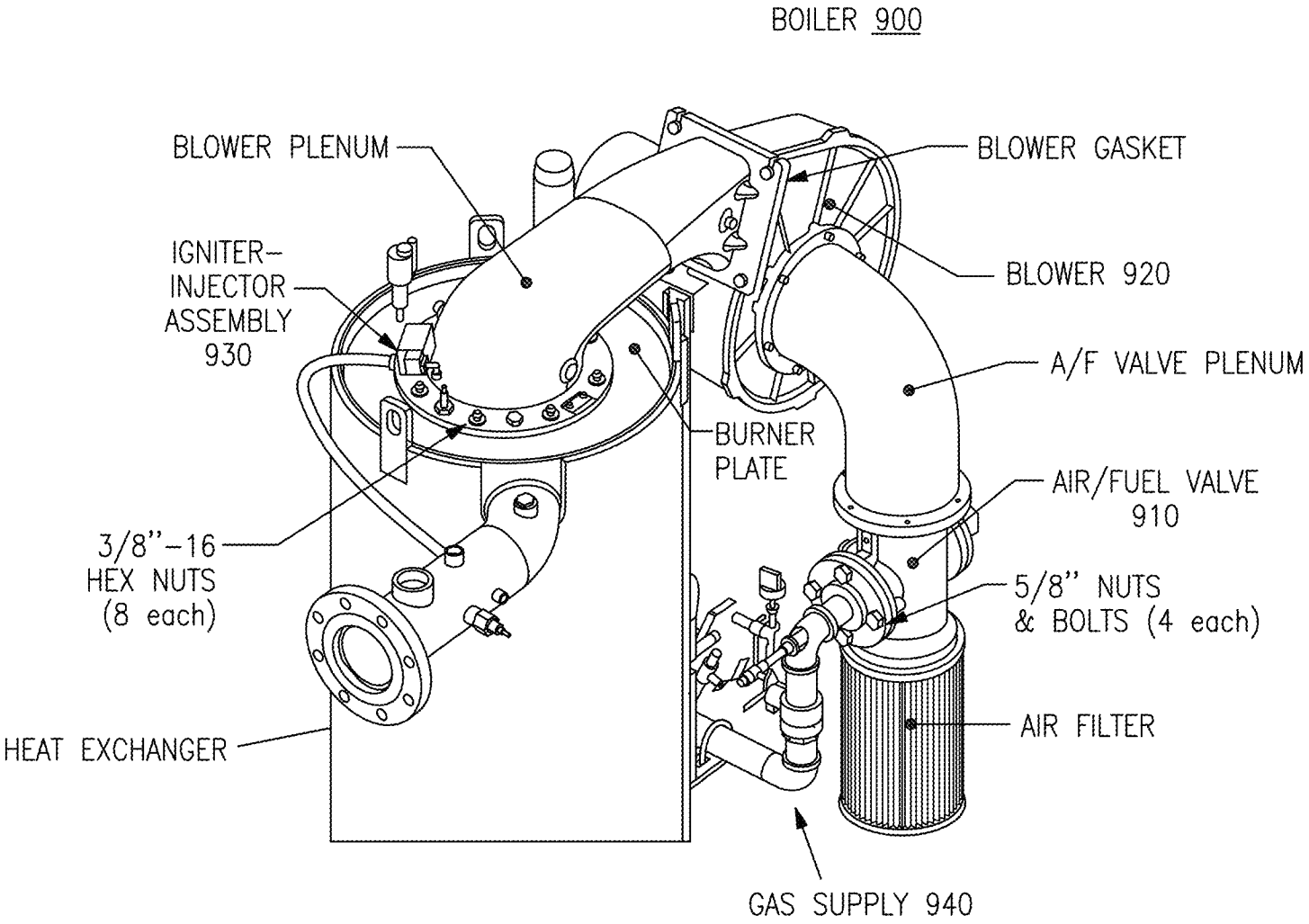
FIG. 9 is a drawing showing a heat exchanger, blower, air fuel valve, and gas supply for the exemplary boiler of FIG. 8.

FIG. 9 is a drawing showing a heat exchanger, blower 920, air fuel valve 910, and gas supply 940 for the exemplary boiler of FIG. 8. The blower 920 is driven by the blower motor. The voltage applied to the blower motor sets the blower speed. Blower voltage and Blower RPM (blower speed) are parameters that are displayed on FIG. 1. Spark current and flame strength are also parameters that are displayed on FIG. 1 of the nonprovisional application as originally filed. The Igniter Solenoid opens the gas assist line solenoid and generates sparking of the igniter until the Ignition Spark control is disabled. The Spark Current (amps draw from spark across igniter) is displayed.

Figure 10:
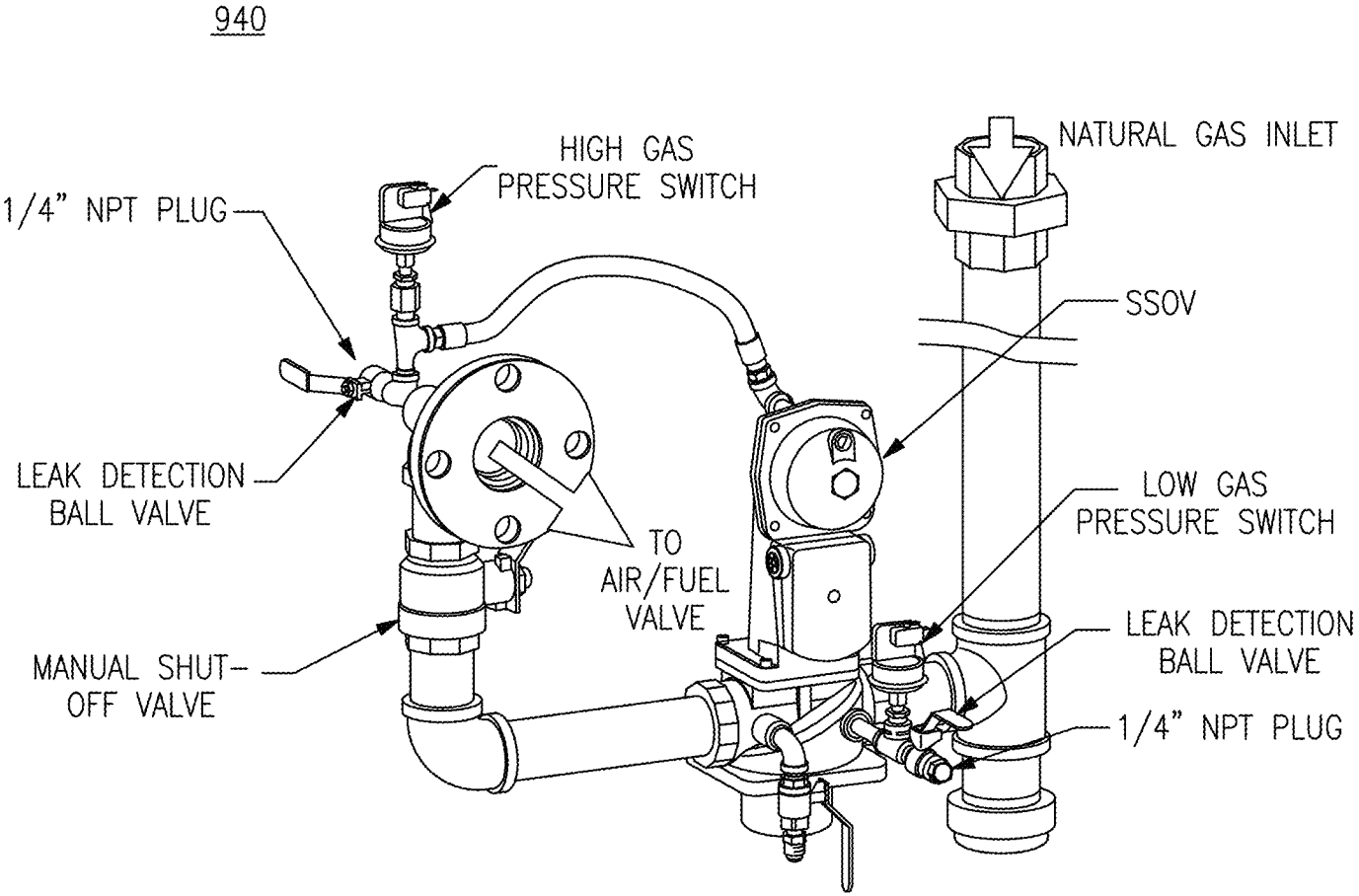
FIG. 10 is a drawing showing the natural gas inlet assembly of FIG. 9 in more detail.

FIG. 10 is a drawing showing the natural gas inlet assembly of FIG. 9 in more detail. Gas pressure is a parameter that is displayed on FIG. 1 of the nonprovisional application as originally filed. The gas supply is off during the pre-start process. Therefore, during the pre-start process, the gas pressure display displays Gas Pressure: "closed".

Figure 11:
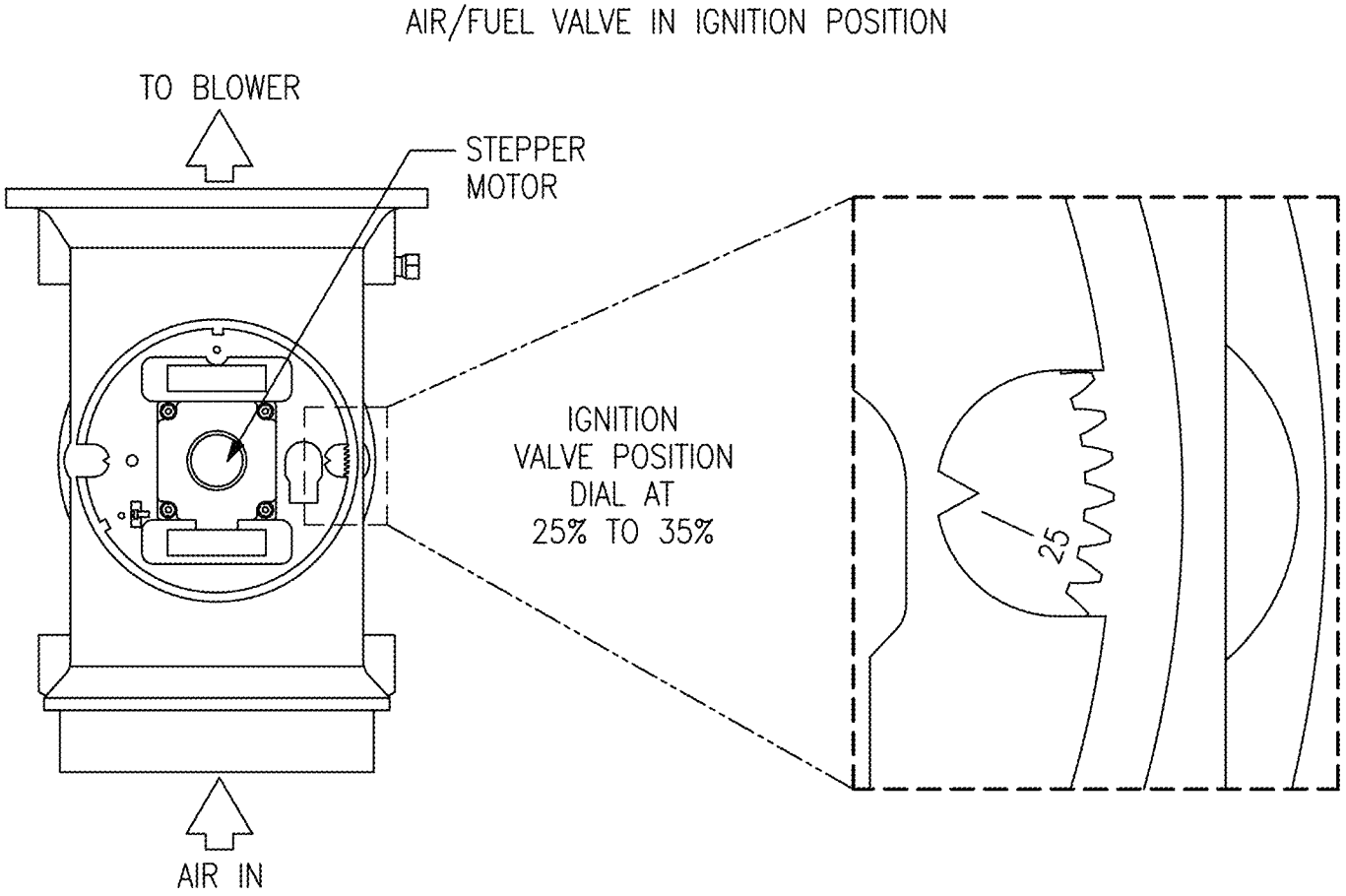
FIG. 11 is a drawing of the exemplary air/fuel valve of FIG. 9 and an associated exemplary valve position.

FIG. 11 is a drawing of the exemplary air/fuel valve of FIG. 9 and an associated exemplary valve position. Valve position out is a parameter displayed in FIG. 1. The valve position out is the position of the air fuel valve.

Figure 12:
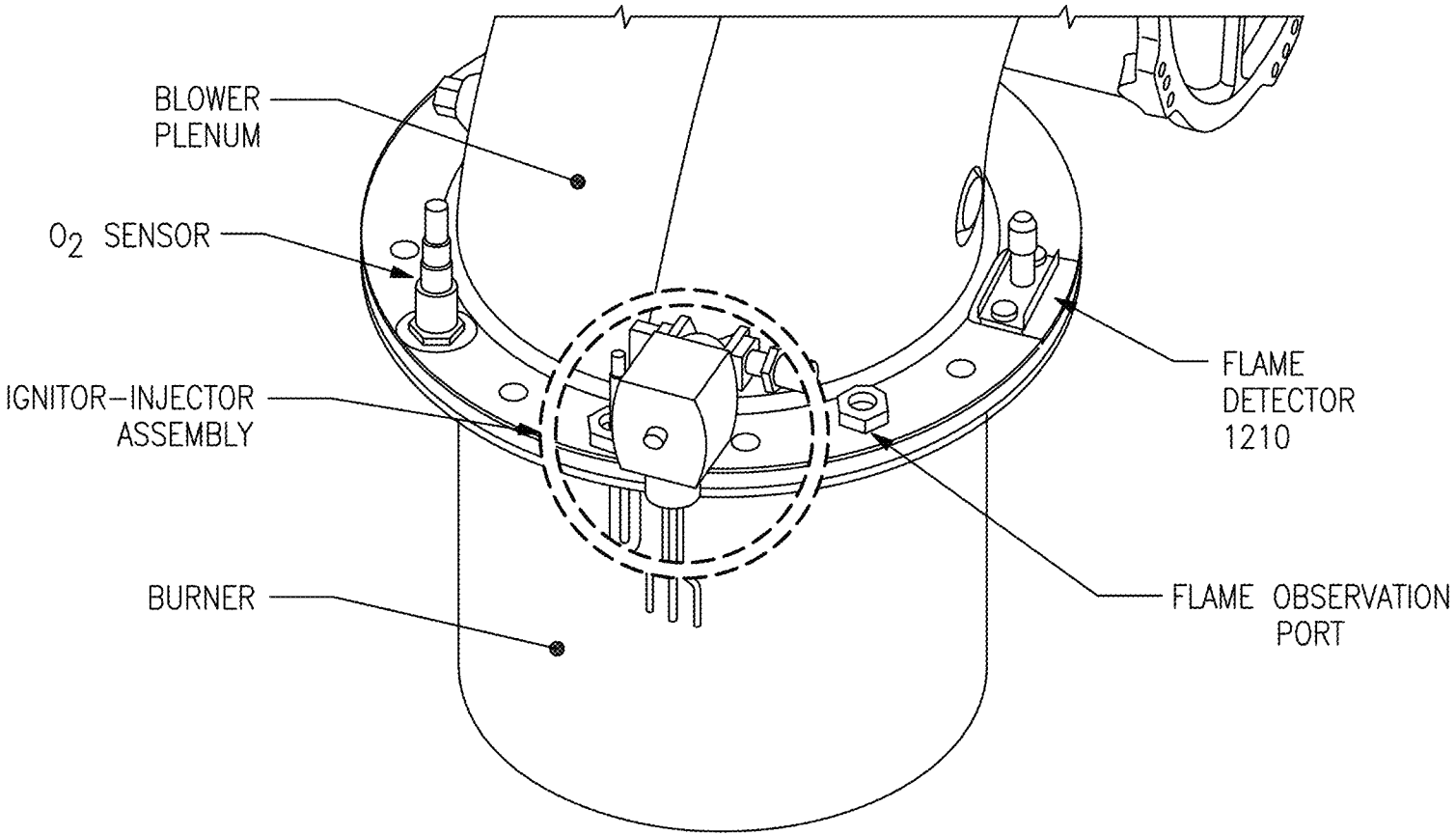
FIG. 12 is a drawing showing an exemplary flame detector mounted on a flange of the plenum of FIG. 9.

FIG. 12 is a drawing showing an exemplary flame detector 1210 mounted on a flange of the plenum of FIG. 9. Strength—remains 0 until the flame sensors senses flame, then displays the flame strength between 0-100%. A flame strength less than 70% can lead to flame loss.

Figure 13:
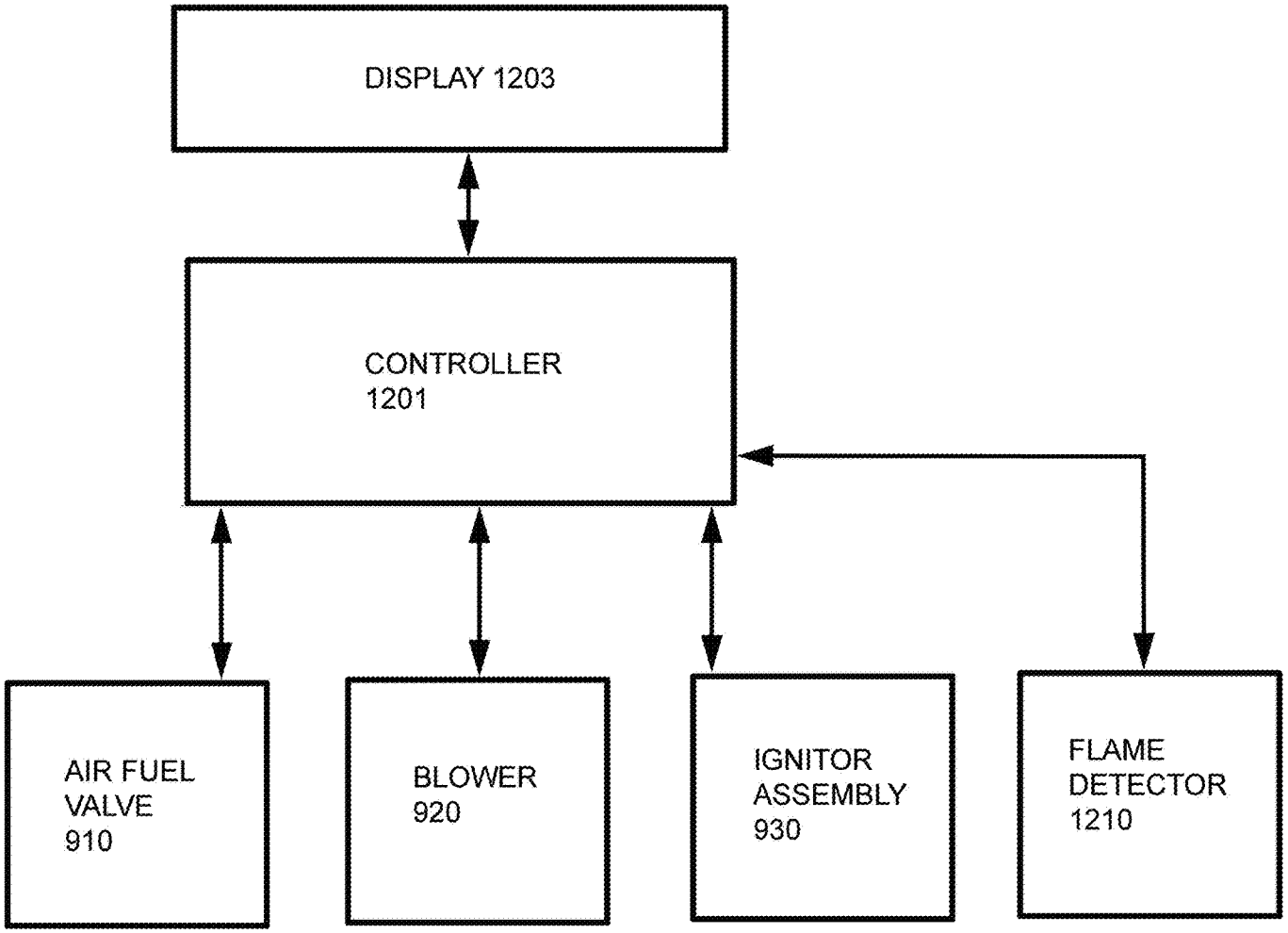
FIG. 13 is a block diagram showing a controller operatively coupled to a display, the air fuel valve, the blower, and the ignitor assembly.

FIG. 13 is a block diagram showing a controller operatively coupled to a display, the air fuel valve 910, the blower 920, the ignitor assembly 930, and the flame sensor 1210.

While the controller is performing the functions on the left side of the flowchart, it can simultaneously check that there is no unsafe condition, fault, error, etc. occurring. All the safety checks are in place. The block for operational integrity applies the entire time the unit is automatically or manually setting the valve balancing function.

Programmed Auto Run

One problem in trouble shooting, diagnosing, and repairing problems with water heaters or boilers is that it can be difficult to recreate certain running conditions at will. For example, there may be some awareness of sequences of operation or profiles that are related to a problem. While some of those sequences might seem random in nature, others are at least generally known or observed sequences, but difficult or impossible to re-produce on demand while the technician is present.

A solution is a new programmed auto run mode where the owner/operator, or more typically, a repair technician can program a suspect profile to intentionally run on demand. By use of the new programmed auto run mode, an otherwise frustrating seeming random sequence can now be run on demand for the repair technician to observe and diagnose the problem that might repeat only during one or a limited number of sequences or profiles of operation.

Figure 6A:
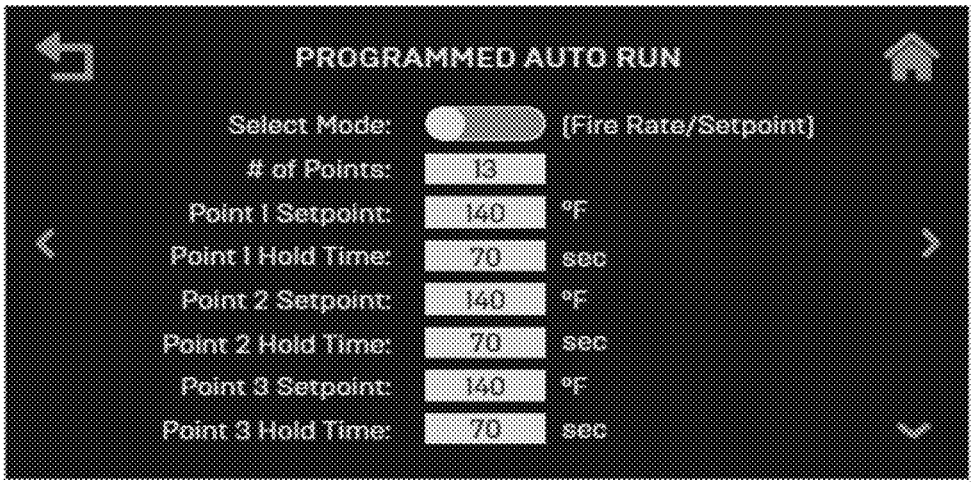
FIG. 6A is a drawing of a programmed auto run GUI to select a sequence of repeating fire rates or setpoints.
Figure 6B:
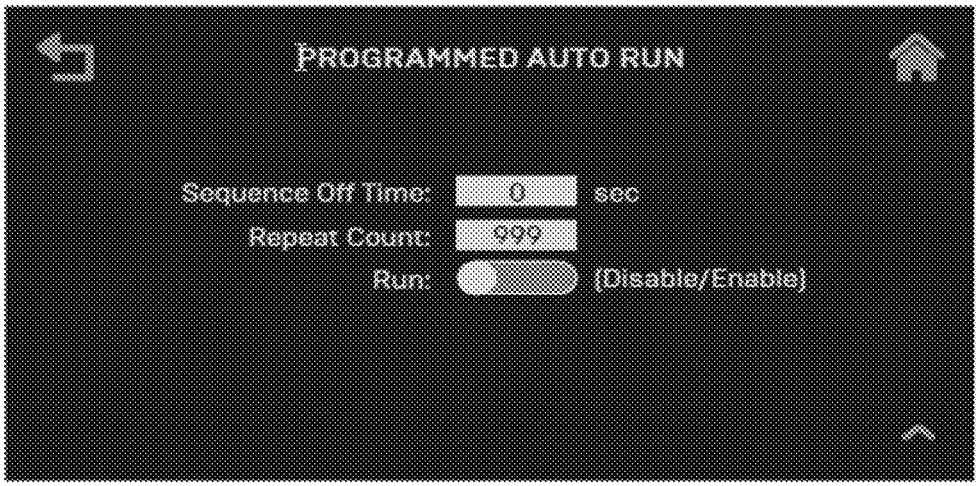
FIG. 6B is a drawing of a programmed auto run GUI to run a programmed auto run profile for a certain number of cycles with a sequence off time between cycles.
Figure 6C:
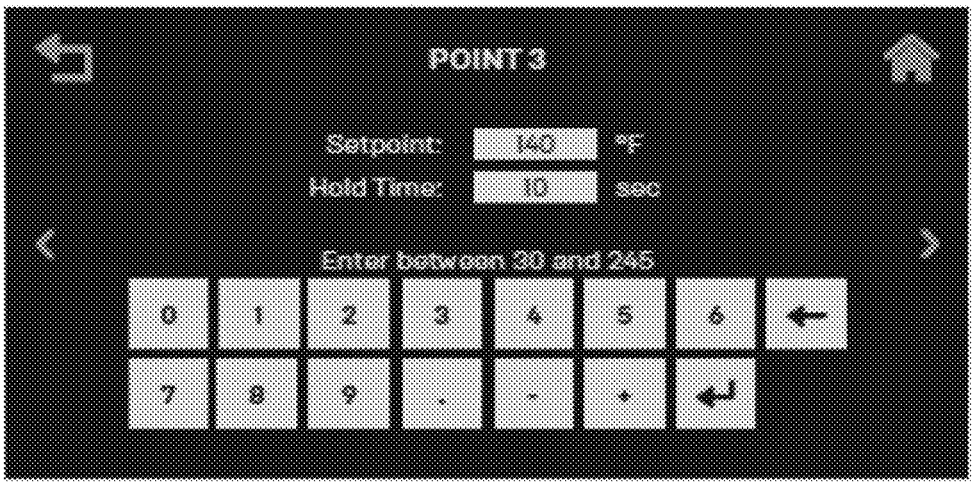
FIG. 6C is a drawing of a programmed auto run GUI for setting each of the setpoints of FIG. 6A.

FIG. 6A to FIG. 6C shows GUIs associated with an exemplary programmed auto run mode for a boiler controller. These GUIs allows one to troubleshoot the unit via custom profile creation and running the custom profile for a specified duration to trigger a condition that is considered to be random in nature and difficult to debug as a result. FIG. 6A is a drawing of a programmed auto run GUI to select a sequence of repeating fire rates or setpoints. The example screen shows the first three points of a sequence of 13 setpoints and hold times for the set points. FIG. 6B is a drawing of a programmed auto run GUI to run a programmed auto run profile for a certain number of cycles with a sequence off time between cycles. FIG. 6C is a drawing of a programmed auto run GUI for setting each of the setpoints of FIG. 6A.

Figure 7:
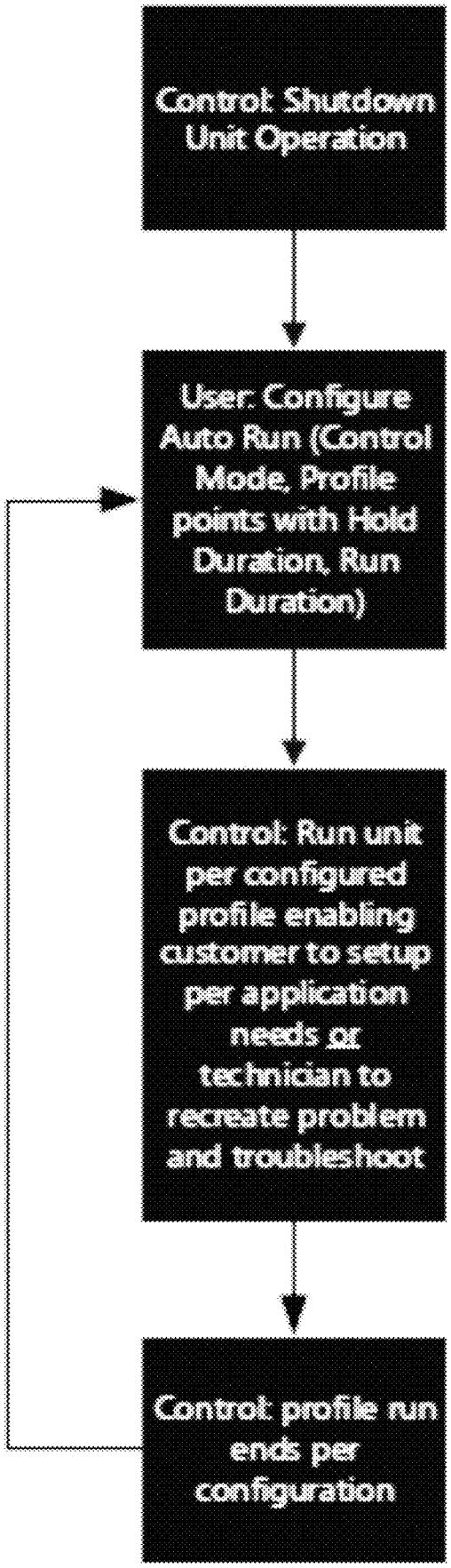
FIG. 7 is a flow chart showing the steps of an exemplar programmed auto run mode.

FIG. 7 is a flow chart showing the steps of an exemplar programmed auto run mode. A) Using the controller, the unit is shutdown; B) The user configures the controller of a boiler or water heater unit for a programmed auto run by setting the control mode, at least one profile with points with hold duration and run duration; C) The controller runs the unit per the configured profile allowing a user to set up for a specific run application, or more typically, allowing a technician to recreate and troubleshoot a problem a problem related to a profile that otherwise might run infrequently or seemingly randomly, and not usually when the technician is present; and D) the programmed auto run mode, on completion of the user application, or technician trouble shooting can be turned off by use of the controller and returned to a normal mode of operation.

Controller (a controller having disposed within one or more processors) code in firmware and/or software to provide the features, functions, and modes for a hot water heater or boiler as described hereinabove can be provided on a computer readable non-transitory storage medium. A computer readable non-transitory storage medium as non-transitory data storage includes any data stored on any suitable media in a non-fleeting manner. Such data storage includes any suitable computer readable non-transitory storage medium, including, but not limited to hard drives, non-volatile RAM, SSD devices, CDs, DVDs, etc.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

All references cited herein are incorporated herein by reference in their entirety and for all purposes to the same extent as if each individual publication, patent or patent application was specifically and individually indicated to be incorporated by reference in its entirety for all purposes.

What is claimed:

1. A flow balancing method for a heating plant having a plurality of boilers or water heaters comprising:

providing a controller having one or more processors operatively coupled to a plurality of boiler or water heater units of a heating plant, each unit of the heating plant including an isolation valve whose position is set by the controller;

initiating by use of said controller an automatic flow balancing process;

obtaining, by said controller, for each unit a current temperature rise (ΔT) defined as a water outlet temperature minus a water inlet temperature; and sequentially going through the plurality of units and, for each unit as it is gone through, automatically setting, by said controller, the position of the isolation valve of that unit responsive to the current temperature rise (ΔT) of the corresponding unit until that unit's ΔT-matches a common target temperature rise.

2. The flow balancing method of claim 1, wherein said step of providing comprises providing said controller operatively coupled to two or more water heaters or boilers which operates said plurality of boiler or water heater units as a cascade of units.

3. The flow balancing method of claim 1, wherein said step of providing further comprises providing a boiler sequencing technology system process which operates a plurality of boilers as part of an integrated boiler control system.

4. The flow balancing method of claim 1, wherein said step of automatically setting said isolation valve position of each unit comprises a valve balancing screen graphical user interface (GUI) showing at least one isolation valve position on a display operatively coupled to said controller.

5. The flow balancing method of claim 1, wherein said step of automatically setting said isolation valve position of each unit comprises a valve balancing screen graphical user interface (GUI) showing all isolation valve positions on a display operatively coupled to said controller.

6. The flow balancing method of claim 1, wherein said step of automatically setting said isolation valve position of each unit comprises a setup and configuration of a balanced flow isolation valve operation on a graphical user interface (GUI) of a display operatively coupled to said controller.

7. The flow balancing method of claim 1, wherein said step of automatically setting said isolation valve position of each unit comprises a valve balancing operation to raise or lower a current water outlet temp minus water inlet temp ΔT of each unit.

8. The flow balancing method of claim 1, wherein said step of automatically setting said isolation valve position of each unit comprises balancing a load across multiple units of said plurality of boiler or water heater units of said heating plant.

9. The flow balancing method of claim 1, wherein prior to said step of automatically setting said isolation valve position of each unit, comprising setting said isolation valve position to either a fully open or a fully closed position.

10. The flow balancing method of claim 1, wherein prior to said step of automatically setting said isolation valve position of each unit, comprising setting all of said isolation valve positions to either a fully open or a fully closed position.

11. The flow balancing method of claim 1, wherein said step of automatically setting said isolation valve position of each unit comprises reducing each isolation valve position to restrict a flow from each hot water outlet of each unit until each ΔT of each unit matches a target ΔT.

12. The flow balancing method of claim 11, wherein said step of automatically setting said isolation valve position of each unit comprises repeating automatically setting said isolation valve position of each unit in a BST cascade, until said each $\Delta T$ of each unit is about equal.

13. The flow balancing method of claim 1, wherein after said step of initiating, a step of setting each unit to a certain fire rate.

* * * * *